US005499607A

United States Patent [19]

Tomisawa

[11] Patent Number: 5,499,607

[45] Date of Patent: Mar. 19, 1996

[54] FUEL CHARACTERISTIC DETECTING SYSTEM FOR INTERNAL COMBUSTION ENGINE

[75] Inventor: Naoki Tomisawa, Atsugi, Japan

[73] Assignee: Unisia Jecs Corporation, Atsugi, Japan

[21] Appl. No.: 408,007

[22] Filed: Mar. 22, 1995

[30] Foreign Application Priority Data

Mar. 23, 1994 [JP] Japan ..... 6-052180

[51] Int. Cl.[6] ..... F02D 41/00

[52] U.S. Cl. ..... 123/435; 73/116; 123/494

[58] Field of Search ..... 123/1 A, 435, 123/494; 73/35.02, 116, 117.3

[56] References Cited

U.S. PATENT DOCUMENTS 4,905,649 3/1990 Washino et al. ..... 123/435
5,191,869 3/1993 Kamioka et al. ..... 123/494
5,363,314 11/1994 Kobayashi et al. ..... 364/497
5,419,296 5/1995 Yamaura ..... 123/435

FOREIGN PATENT DOCUMENTS 63-17432 2/1988 Japan .
6-195840 8/1993 Japan .

*Primary Examiner*—Tony M. Argenbright
*Attorney, Agent, or Firm*—Foley & Lardner

[57] ABSTRACT

To detect the volatility of fuel accurately and speedily, a system for an internal combustion engine is arranged to gradually increase only the fuel supply quantity for a specified cylinder, while monitoring a variation of a combustion pressure in the specified cylinder, until the variation exceeds a predetermined level. The amount of fuel increase (such as AFR) obtained at the time the variation exceeds the predetermined level is used as a parameter representing the volatility of the fuel.

11 Claims, 7 Drawing Sheets

FUEL CHARACTERISTIC DETECTING SYSTEM FOR INTERNAL COMBUSTION ENGINE

BACKGROUND OF THE INVENTION

The present invention relates to a system for detecting a fuel characteristic, such as the volatility of the fuel, for an internal combustion engine.

In one conventional example (as disclosed in Japanese Patent Provision (Unexamined) Publication No. H5-195840), in view of the fuel increase quantity required for cold engine enrichment differing depending on the characteristic of fuel (the volatility of fuel), a control system is arranged to decrease the above-mentioned fuel increase quantity to the maximum degree within a range not causing a surge torque to exceed a permissible limit, and by so doing, to prevent the above-mentioned fuel increase quantity from becoming excessive beyond the requirement of the fuel being used.

This conventional system is, however, arranged to apply the result of modification of the enrichment coefficient dependent on the coolant temperature, to all the cylinders. Therefore, this system can deteriorate the engine driveability significantly by modifying the fuel increase quantity beyond an optimum level (minimum level). To avoid this undesired effect, this system must decrease the enrichment coefficient very gradually, and cannot increase the speed of decrease to reach the minimum correction level, so that a considerable time is required until an appropriate level is reached finally.

Even though the fuel injection quantities are modified equally for all the cylinder, the air/fuel ratios of the individual cylinders are not the same because of differences in the injecting characteristics of the fuel injectors and irregular distribution of the intake air, and there is involved a detection error of an air flow meter for measuring an amount of intake air. Consequently, the coolant temperature enrichment coefficient finally obtained from the modification control is not necessarily appropriate for representing the volatility of the fuel.

SUMMARY OF THE INVENTION

It is therefore an object of the present invention to provide a fuel characteristic detecting system which can detect the characteristic of fuel speedily without being affected by system dispersions and errors and without affecting the engine performance so much.

According to some embodiments of the present invention, as shown in FIG. 1, a fuel characteristic detecting system for an internal combustion engine, comprises:

a combustion pressure variation sensing means for sensing a variation of a combustion pressure in a specified cylinder of the engine;

an air/fuel ratio controlling means for forcibly varying an air fuel/ratio for the specified cylinder until the variation of the combustion pressure sensed by said combustion pressure variation sensing means becomes equal to or greater than a predetermined level; and a fuel characteristic detecting means for determining a fuel characteristic in accordance with an air fuel/ratio in said specified cylinder obtained when the variation of the combustion pressure is made equal to or greater than the predetermined level by the forcible variation of the air fuel ratio by the air fuel ratio controlling means.

In an internal combustion engine, a lean side combustion limit and a rich side combustion limit are greatly influenced by the volatility of fuel. In general, the air/fuel ratio required to maintain a normal combustion is smaller (richer) when the volatility of fuel is lower. Accordingly, the detecting system of the invention is devised to detect at least one of the lean and rich combustion limits by forcibly shifting the air/fuel ratio until the variation of the combustion pressure exceeds the predetermined level, and to detect the fuel characteristic such as the volatility, in dependence on the air/fuel ratio value at the combustion limit.

The forcible shift of the air/fuel ratio to detect the fuel characteristic is performed only in one specified cylinder (or only in a small part of the cylinders), so that the variation of the combustion pressure due to the forcible shift in the specified cylinder does not exert intolerable adverse influence on the engine driveability. Consequently, it is possible to increase the rate of change of the air/fuel ratio without deteriorating the engine driveability. By monitoring the change of the combustion pressure in the specified cylinder to which the air/fuel ratio is changed, the detection system can reliably detect the change of the combustion stability due to the change of the air/fuel ratio.

A fuel characteristic detecting system can be arranged so that said fuel characteristic detecting means determines the air/fuel ratio at the time that the variation of the combustion pressure becomes equal to or greater than the predetermined level, in accordance with the forcible variation of the fuel supply quantity to said specified cylinder. In other words the air/fuel ratio value can be determined in accordance with a modification quantity applied to a base air/fuel ratio.

DETAILED DESCRIPTION OF THE INVENTION

Figure 2:
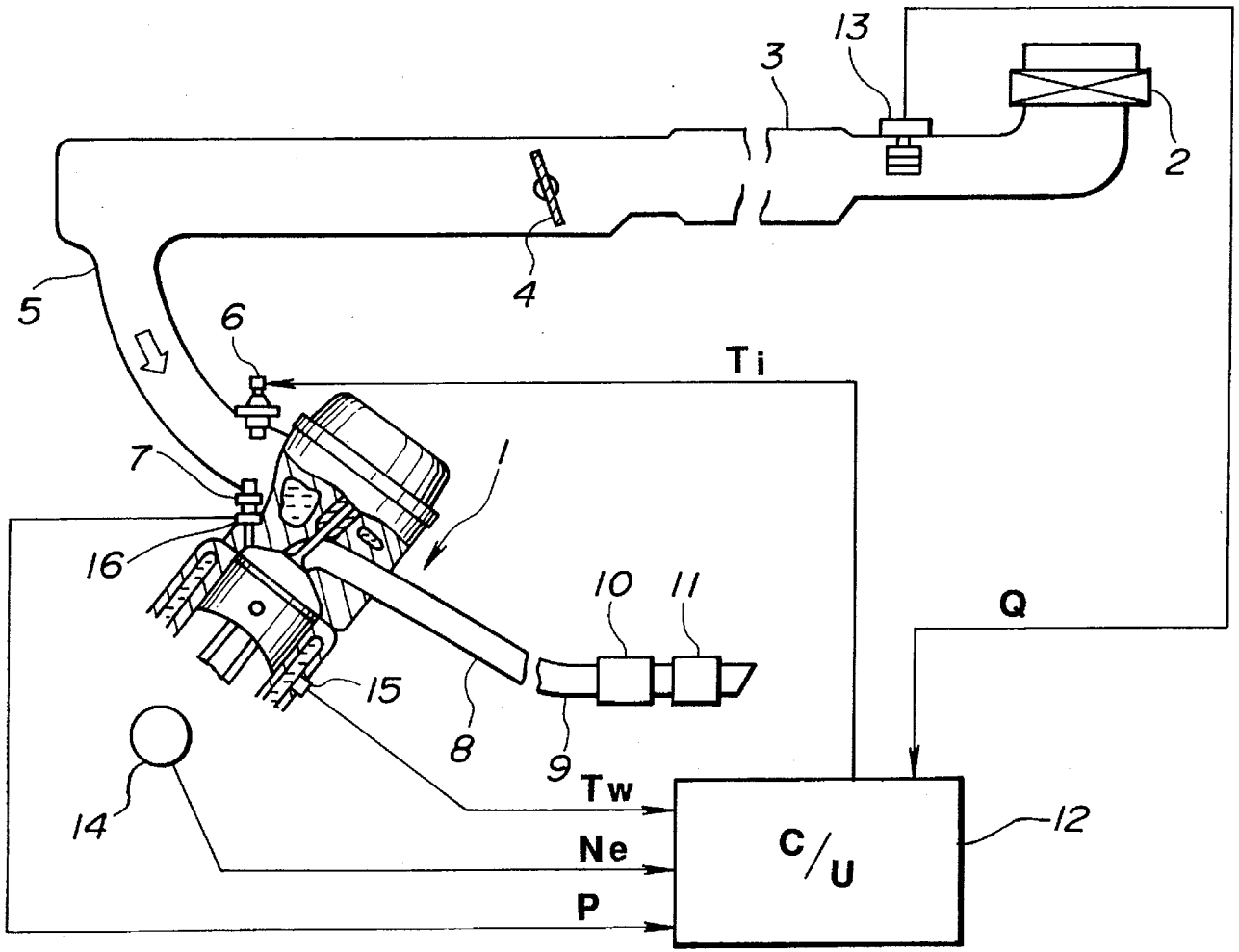
FIG. 2 is a schematic view showing an engine system employed in each of illustrated embodiments of the present invention.

FIG. 2 shows an engine system which can be employed in the present invention. In the engine system shown in FIG. 2, air is drawn into an internal combustion engine 1 through an air cleaner 2, an intake duct 3, a throttle valve 4, and an intake manifold 5. In branches of the intake manifold 5, there are provided fuel injection valves 6 for individual cylinders of the engine 1. In this example, each cylinder has a unique one of the fuel injection valves 6. Each fuel injection valve 6 serves as a fuel supplying means.

The fuel injection valves 6 of this example are electromagnetic type injectors. Each injector 6 is opened when its solenoid is energized, and closed when the solenoid is deenergized. Each injector 6 is electrically connected with a control unit 12. The control unit 12 controls each injector 6 by sending a drive pulse signal. A fuel pump (not shown) delivers fuel under pressure, and a pressure regulator (not shown) regulates the pressure of fuel at a predetermined level. The injectors 6 receive the fuel of the thus-regulated pressure, and supply the fuel by injection to the engine intermittently under the control of the control unit 12.

In each combustion chamber of the engine 1, there is provided an ignition plug 7 for producing a spark to ignite a fuel-air mixture in the cylinder. Exhaust gases from the engine 1 are conveyed through an exhaust manifold 8, an exhaust duct 9, a catalytic converter 10 and a muffler 11.

The control unit 12 is designed to electronically control the fuel supply to the engine 1. The control unit 12 of this example has a microcomputer which, in this example, comprises a CPU, at least one ROM, at least one RAM, at least one A/D converter, and an input and output interface section. The control unit 12 receives input signals from various sensors and controls the injectors 6 by performing a predetermined control procedure.

The sensor group of this example is as follows.

An air flow sensor (or air flow meter) 13 is provided in the intake duct 3, and arranged to produce a signal representing an intake air flow quantity Q to the engine 1.

A crank angle sensor 14 produces a reference angle signal REF for signaling every reference angular position (each TDC, for example), and a unit angle signal POS for signaling every 1° or 2° of crankshaft rotation. By measuring the period of the reference angle signal REF, or the number of occurrences of the unit angle signal within a predetermined time interval, it is possible to calculate an engine rotational speed (rpm) Ne. The crank angle sensor 14 serves as an engine speed sensor.

A coolant temperature sensor 15 senses the temperature Tw of a cooling water in a water jacket of the engine 1.

A cylinder pressure sensor 16 is provided in each cylinder for sensing the pressure in each cylinder, in this example. In this example, the pressure sensor 16 is disposed, as a washer, on each ignition plug 7 as disclosed in Japanese Utility Model Provisional (Unexamined) Publication No. S63-17432. The pressure sensors 16 of this type each comprise a ring-shaped piezoelectric element and at least one electrode, which are pressed between the cylinder head and the corresponding ignition plug 7.

In the present invention, a means for sensing the pressure in an engine cylinder is not limited to the above-mentioned washer type sensor. It is possible, for example, to employ a pressure sensor of a type having a sensing section which is directly exposed in a combustion chamber and arranged to sense the pressure in the chamber as an absolute pressure.

By performing operations according to a control program stored in the ROM, the CPU of the microcomputer in the control unit 12 computes a fuel injection quantity (or fuel supply quantity) Ti, and delivers a drive pulse signal having a pulse width (or pulse duration) corresponding to the computed fuel injection quantity Ti, to each injector 6 according to a predetermined timing schedule of injection timing.

The fuel injection quantity Ti is computed according to the following equation.

$$Ti=Tp\times Co+Ts$$

where Tp is a basic fuel injection quantity, Co is a coefficient for various corrections, and Ts is a voltage correction (quantity). The basic injection quantity Tp is a basic quantity corresponding to a desired air/fuel ratio, and is determined in accordance with the intake air flow quantity Q and the engine speed Ne. The voltage correction quantity Ts is a term for compensating for an increase in an invalid injection quantity due to lowering of a battery voltage.

The coefficient Co for various corrections is computed according to the following equation.

$$Co=\{1+K_{TW}+K_{AS}+K_{ACC}+\ldots\}$$

where $K_{TW}$ is a correction coefficient for water temperature enrichment, $K_{AS}$ is a correction coefficient for "after start" enrichment, and $K_{ACC}$ is a correction coefficient for acceleration enrichment. The water temperature correction coefficient $K_{TW}$ is a correction term to increase the fuel injection quantity when the cooling water temperature Tw is low. The after start correction coefficient $K_{AS}$ is a term for increasing the fuel injection quantity immediately after starting (during a predetermined time interval from the end of cranking). This after-start increase of the fuel injection quantity is increased when the cooling water temperature Tw is low. An initial value for the after start enrichment is determined in accordance with the cooling water temperature Tw at the end of cranking, and thereafter the fuel increase quantity of the after start enrichment is decreased gradually at a predetermined rate until the fuel increase quantity is finally reduced to zero. The acceleration enrichment coefficient $K_{ACC}$ is a term to increase the fuel injection quantity to prevent the air/fuel ratio from becoming lean during acceleration of the engine.

These requirements for correction of the fuel injection quantity contained in the correction coefficient Co are varied in dependence on properties of fuel, specifically depending on a degree of lightness (or heaviness) of the fuel (or a rate at which the fuel evaporates). The quantities of the fuel increase for the water temperature enrichment ($K_{TW}$) and the acceleration enrichment ($K_{ACC}$) are required to be greater when the fuel is heavy and slow in evaporating than when the fuel is light and volatile.

Therefore, the initial values of the water temperature enrichment coefficient $K_{TW}$ and the acceleration enrichment coefficient $K_{ACC}$ are generally adapted to the highest level required by the heavy fuel (low in volatility) in order to prevent the air/fuel ratio from becoming too lean and the engine operation from becoming unstable.

When, however, the fuel actually supplied to the engine is lighter, the thus-determined initial values for the enrichments tend to increase the fuel quantity excessively and incur deteriorate in exhaust performance (such as an increase in HC concentration).

Figure 3:
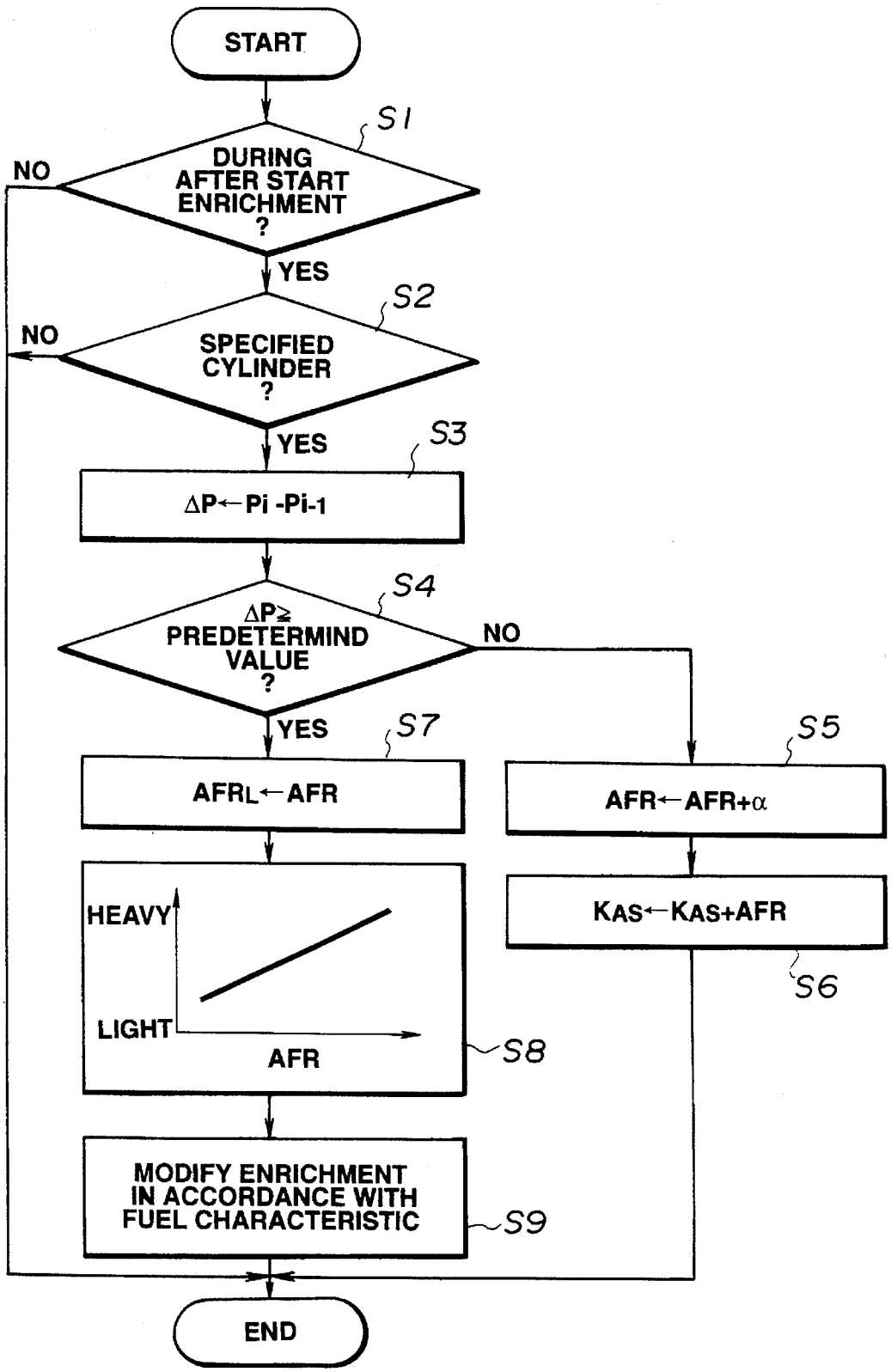
FIG. 3 is a flow chart showing a fuel characteristic detecting procedure according to a first embodiment of the present invention.

In the control system according to a first embodiment of the present invention, therefore, the control unit 12 indirectly detects the volatility (or the degree of lightness) of the fuel according to the program shown in FIG. 3, and modifies the water temperature enrichment coefficient KTW and/or the acceleration enrichment coefficient KACC in accordance with the result of the fuel volatility detection, to modified levels suitable to the volatility of the fuel being actually supplied to the engine.

Figure 1:
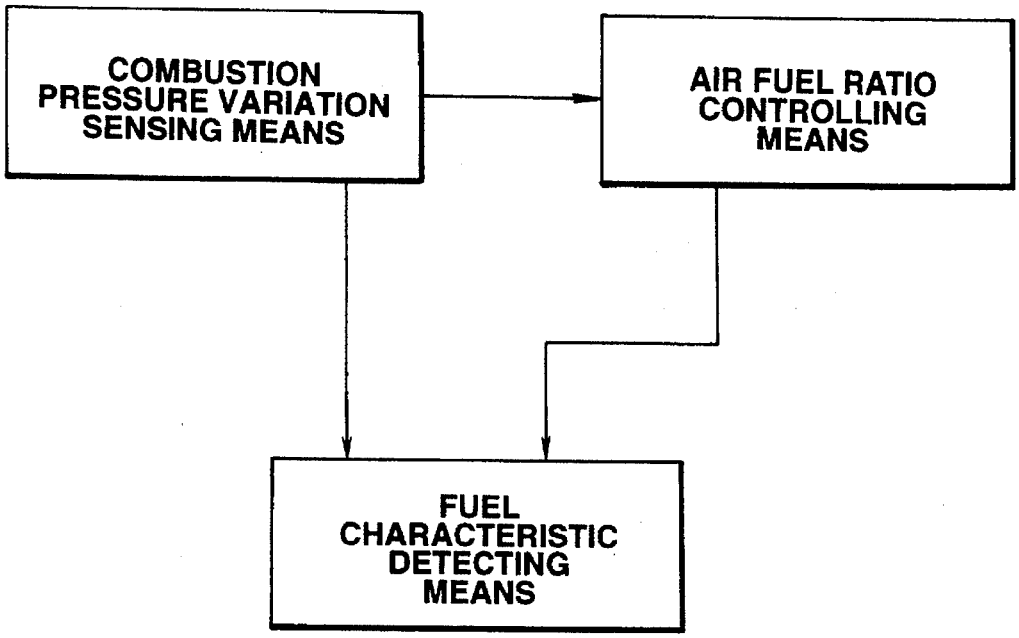
FIG. 1 is a block diagram showing, as an example, an arrangement of functional means employed in the present invention.

In this embodiment, the control unit 12 having the software program as shown in FIG. 3 serves as at least parts of the air/fuel ratio controlling means and the fuel characteristic detecting means shown in FIG. 1. The function of the combustion pressure variation sensing means is performed by the control unit 12 programmed as shown in FIG. 3 and at least one of the cylinder pressure sensors 16.

At a step S1 of FIG. 3, the control unit 12 (or the CPU of the control unit 12) determines whether the period for the enrichment by the after start coefficient KAS (the period after start) continues. If the after start enrichment is under way, the control unit 12 proceeds to a step S2, and discriminates a selected one of the cylinders of the engine at the step S2. The selected cylinder is preliminarily specified for the fuel characteristic detection. It is possible to always select the same cylinder as the selected cylinder, or to select a different cylinder each time the fuel characteristic detection is made. If the cylinder currently being examined is the selected cylinder, then the control unit 12 proceeds to a step S3. If the after start enrichment is not in progress, or if the currently examined cylinder is not the selected cylinder, then the control unit 12 proceeds directly to the end of the procedure of FIG. 3.

At the step S3, the control unit 12 determines a cylinder pressure variation (or a combustion pressure variation) in the selected cylinder. In this example, the cylinder pressure variation is a variation ΔPi of an integral Pi of the cylinder pressure in the selected cylinder.

The integral Pi is the result of integration of the cylinder pressure P over a predetermined interval (for example, TDC~ ATDC 30°). The variation (that is, the quantity by which the integral Pi is increased or decreased) ΔPi is a difference resulting from subtraction of the previous value Pi−1 of the integral obtained on the previous integration interval, from the most recent value Pi of the integral on the most recent integration interval.

Instead of employing the integral Pi, it is possible to employ a sampling process to obtain a sampled value of the cylinder pressure P at a predetermined crank angle position. The calculation of the integral Pi is preferable because the integral Pi is not readily influenced by noises.

At a step S4 following the step S3, the control unit 12 compares the variation ΔPi with a predetermined value o corresponding to a tolerance limit of the variation ΔPi.

If the variation ΔPi is smaller than the predetermined value, then the control unit 12 proceeds from the step S4 to a step S5 on the presumption that a rich combustion limit is not exceeded and accordingly the integral Pi of the cylinder pressure is not varied so much.

At the step S5, the control unit 12 increases an increase quantity AFR by a predetermined amount α. The increase quantity AFR is a correction quantity for increasing the after start enrichment coefficient KAS. The increase quantity AFR is initially set at an initial value of zero.

At a step S6, the control unit 12 increases the after start enrichment coefficient KAS by adding the increase quantity AFR increased at the step S5, to the current value of the after start enrichment coefficient KAS. As a result, the control system computes the fuel injection quantity Ti for the selected cylinder by using the after start enrichment coefficient KAS increased at the step S6.

As to the remaining cylinders other than the selected cylinder, the control system determines the fuel injection quantity Ti by using the after start enrichment coefficient KAS determined without modification, and controls the fuel injectors for the remaining cylinders according to a normal control characteristic.

Figure 7:
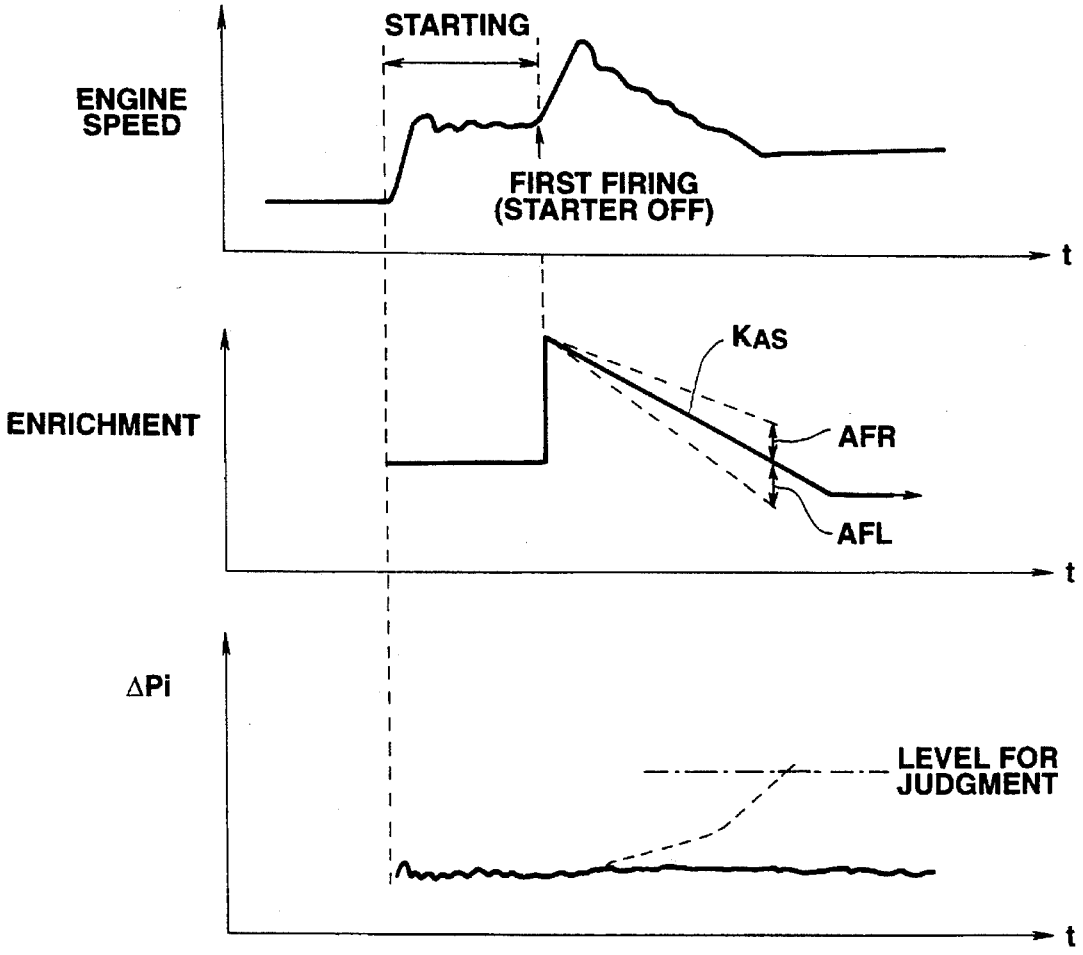
FIG. 7 is a time chart showing air/fuel ratio control characteristics in the embodiments of the present invention.

In the selected cylinder, on the other hand, the increase quantity AFR for the after start enrichment coefficient KAS is increased gradually, and the amount of fuel increase is increased gradually as compared with the remaining cylinders (in a periodical manner in each repetition of the steps S5 and S6). Consequently, the air/fuel ratio in the selected cylinder is decreased and enriched gradually as compared with the remaining cylinders, as shown in FIG. 7.

The operations of the steps S5 and S6 are repeated until the variation ΔPi exceeds the predetermined level. When the rich combustion limit is approached and exceeded because of this forcible enrichment of the selected cylinder, the combustion becomes unstable and hence the variation ΔPi comes to increase beyond the predetermined level.

When the variation ΔPi thus becomes equal to or greater than the predetermined value, the control unit 12 proceeds from the decision step S4 to a step S7, at which the then-existing value of the increase quantity AFR for the selected cylinder is set as a data item AFRL. The data item AFRL is used as data representing the air/fuel ratio corresponding to the rich combustion limit.

When the fuel is volatile, the injected fuel readily atomizes, and the rich combustion limit is reached with a relatively greater air/fuel ratio. In the case of the fuel of a low volatility, the atomization of the injection fuel is slow, and the rich combustion limit is not reached until a larger amount of the fuel is injected, and the air/fuel ratio is made lower.

At a step S8 following the step S7, accordingly, the control unit 12 judges the volatility of the fuel by the data item AFRL which is the value of the fuel increase quantity AFR used when the variation ΔPi exceeds the predetermined level. The fuel volatility is considered to be low (the fuel is heavy) when AFRL is greater, that is, when a greater fuel enrichment correction is allowed (the rich combustion limit is reached with a lower air/fuel ratio).

At a next step S9, the control unit 12 modifies the water temperature enrichment coefficient KTW and the acceleration enrichment coefficient KACC in accordance with the result of the estimation of the fuel volatility at the step S8, to adapt the enrichments for the property of the actual fuel now being used.

The water temperature enrichment coefficient KTW and the acceleration enrichment coefficient KACC are generally set to the values suitable to the heaviest possible fuel of the lowest volatility among the all predictable varieties of fuel. These values are not suitable for a lighter kind of fuel. However, the control system according to this embodiment can detect the use of a lighter fuel having a relatively high volatility, and prevent an over-enrichment in excess of the requirement of the lighter fuel by restraining the fuel increase by the water temperature enrichment coefficient KTW and the acceleration enrichment coefficient KACC at the step S9.

It is possible to use the result of judgment of the fuel volatility according to the present invention for modification of the ignition timing of the engine, and for other engine or vehicle control systems.

In the first embodiment of the invention, the fuel injection quantity for only one specified cylinder is made greater forcibly and gradually than the fuel injection quantities for the other cylinders. During this, the fuel characteristic detecting system according to the first embodiment monitors the width of variation ΔPi (namely, output fluctuation) of the integral Pi of the cylinder pressure within the specified cylinder, and determines the amount of fuel increase at the instant at which the width of the variation ΔPi reaches the predetermined level of judgment. In accordance with the thus-determined correction quantity for fuel increase allowed until that instant, the detection system estimates the fuel property (volatility).

This forcible enrichment to the specified cylinder causes output fluctuation. However, the other cylinders are controlled by the normal injection control mode so as to prevent large output fluctuation. As a whole, the engine driveability remains in a satisfactory region, and the exhaust emission performance is not affected so much by the forcible enrichment. It is therefore possible to increase the speed of the fuel characteristic detecting operation by setting the rate at which the fuel enrichment correction quantity is gradually increased, at a sufficiently high level.

In the system arranged to modify the conditions of the cylinders all together and to detect a resulting change in surge torque, it is not possible to accurately catch an influence on stability of combustion by the modification of the air/fuel ratio because of cylinder to cylinder variations in the air/fuel ratio. The detection system according to this embodiment, by contrast, is arranged to modify the injection quantity only in one specified cylinder, and to detect the result of the modification in the specified cylinder. Therefore, the system of this embodiment can detect the fuel characteristic accurately by detecting a change of the combustion stability due to the air/fuel modification securely.

In this embodiment, the forcible fuel enrichment is performed during the after start enrichment operation. Therefore, the detection system of this embodiment can detect the fuel property soon after a start of the engine, and control the fuel supply quantity thereafter by using the data modified in accordance with the result of the detection. The detection system of this embodiment can make the full use of the result of the fuel property detection.

In the example shown in FIG. 3, the fuel characteristic is determined by using the fuel increase correction quantity AFRL of the after start enrichment coefficient KAS at the time the variation ΔPi exceeds the predetermined level. However, it is optional to determine the fuel characteristic by using an integral of the fuel increase quantity AFR from the start of the forcible enrichment to the time the variation ΔPi exceeds the predetermined level.

Figure 4:
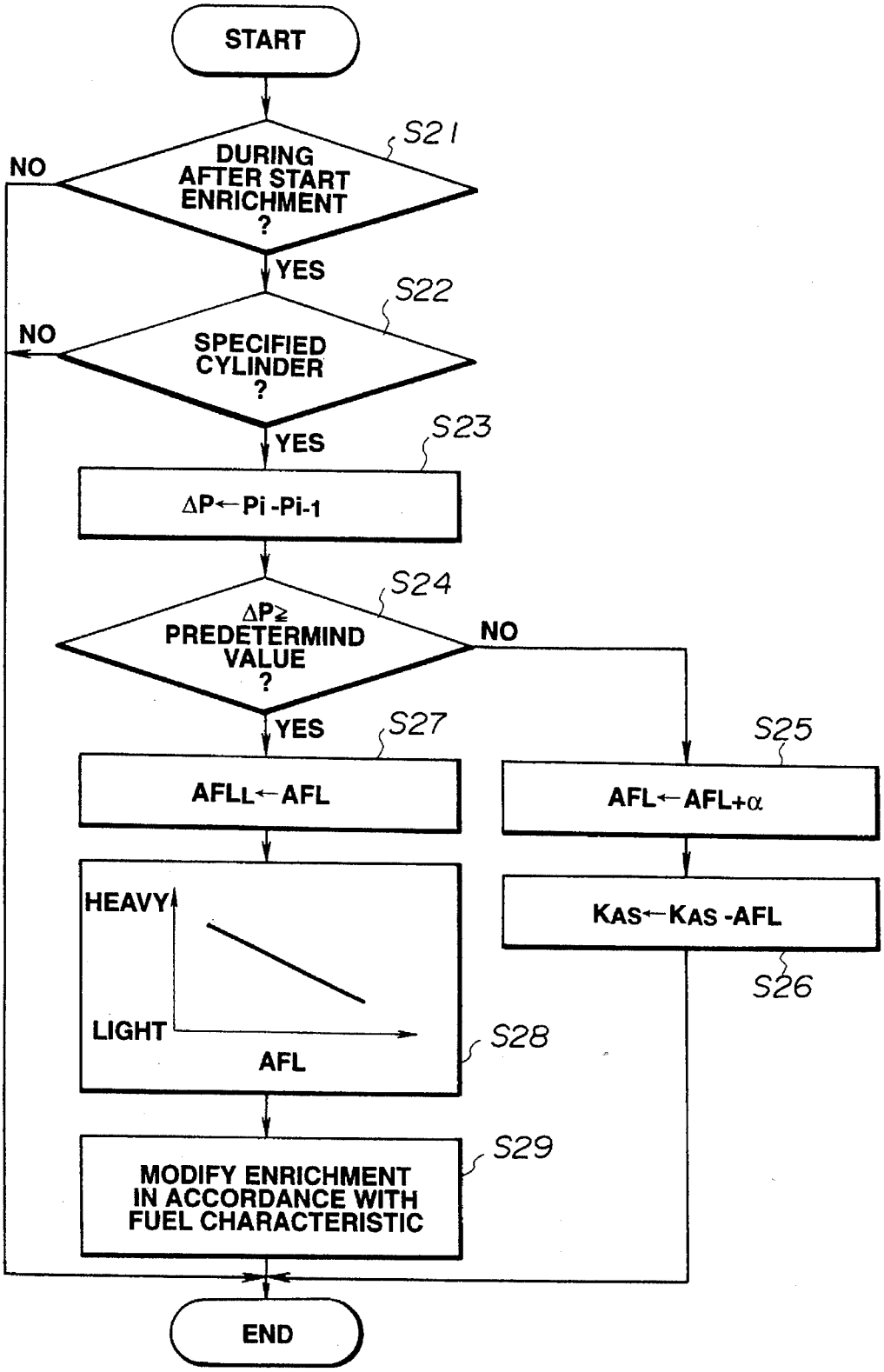
FIG. 4 is a flow chart showing a fuel characteristic detecting procedure according to a second embodiment of the present invention.

FIG. 4 shows a fuel characteristic detecting procedure according to a second embodiment of the present invention. The detection system according to the second embodiment is arranged to forcibly decrease the fuel injection quantity for a specified cylinder (forcibly increase the air/fuel ratio), and to determine the fuel characteristic by using the decrease quantity obtained when a lean combustion limit is reached (cf. FIG. 7).

Steps S21~S24 and S29 are substantially identical to the steps S1~S4 and S9 of FIG. 3. The program of FIG. 4 is different from FIG. 3 only in steps S25, S26 and S27 for adjustment of the after start enrichment coefficient KAS and in the characteristic used for judging the volatility of the fuel in a step S28.

At the steps S25 to S28, the control unit 12 according to the second embodiment decreases the after start enrichment coefficient KAS gradually by increasing a decrease quantity AFL gradually. By thus decreasing the after start enrichment coefficient KAS, the detection system forces the fuel injection quantity to the specified cylinder to become lower than the injection quantities to the other cylinders, and increase (or enlean) the air/fuel ratio of the specified cylinder. When the operating condition in the specified cylinder reaches a lean combustion limit because of this forcible enleanment, and the monitored quantity, that is the variation ΔPi, becomes equal to or greater than the predetermined value, the answer of the decision step S24 becomes affirmative, and the decrease quantity AFL at that instant is stored as AFLL at the step S27. The volatility of the fuel is determined in accordance with this value AFLL at the step S28.

A heavy fuel having a low volatility and a poor ability of atomization requires a more fuel injection quantity (a lower air/fuel ratio) to ensure a normal combustion. Therefore, even by a slight decrease of the fuel injection quantity, the operating condition is forced to the lean combustion limit, and the monitored variation ΔPi is increased beyond the predetermined level. Therefore, when the fuel decrease correction quantity AFLL of the after start enrichment coefficient KAS at the time the variation ΔPi reaches the predetermined level is small, then the fuel is considered to be heavy and low in volatility.

The step S28 is therefore arranged to decrease the estimated volatility of the fuel (to increase the estimated degree of heaviness of the fuel) as the fuel decrease quantity decreases.

With this forced decrease of the fuel injection quantity (the forced enleanment), the detection system according to the second embodiment can detect the fuel property without incurring an increase of the HC content in the exhaust emission.

Figure 5:
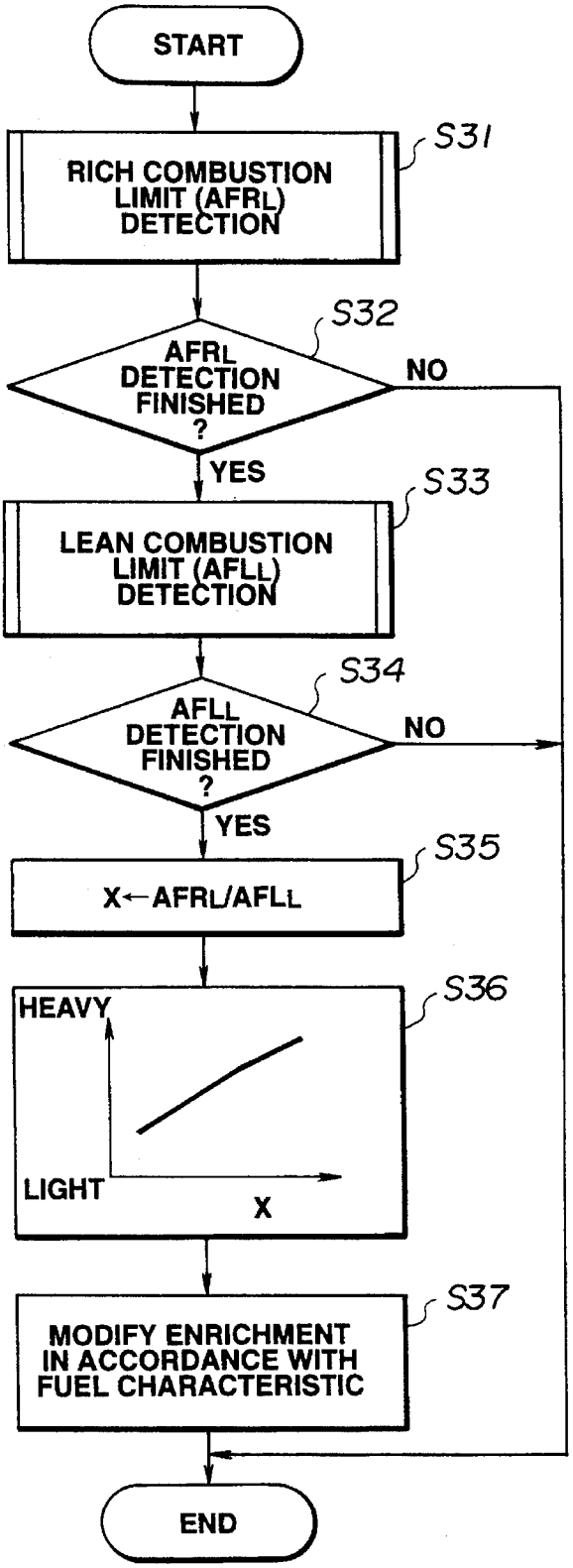
FIG. 5 is a flow chart showing a fuel characteristic detecting procedure according to a third embodiment of the present invention.

FIG. 5 shows a fuel characteristic detection procedure according to a third embodiment of the present invention. In the first and second embodiments, the fuel characteristic detection is made by either the forced enrichment or the forced enleanment. The third embodiment is arranged to perform both of the forced enrichment and the forced enleanment, and detect the fuel characteristic trait by using the results of both the forced enrichment and the forced enleanment.

The detection procedure of FIG. 5 is designed to perform the fuel characteristic detection by the forced enrichment (detection of the rich combustion limit) and the fuel characteristic detection by the forced enleanment (detection of the lean combustion limit) separately in an asynchronous manner, one after the other in the same cylinder.

At a step S31 of FIG. 5, the control unit 12 according to the third embodiment performs the operations of the steps S1~S7 shown in FIG. 3. In the step S31, therefore, the control unit 12 performs the operations until the fuel increase quantity AFRL is sampled at the time the rich combustion limit is reached as the result of the forced enrichment. In the step S31, the determination of the fuel characteristic based on the sampled data is not performed yet.

At a step S32, the control unit 12 determines whether the detection of AFRL has been completed or not. A program section of a step S33 and subsequent steps is not entered until the quantity AFRL is determined by the forcible enrichment control.

When the detection of AFRL is finished, the control unit 12 proceeds from the step S32 to the step S33, and performs, in the step S33, the operations of the steps S21~S27 of FIG. 4. In the step S33, therefore, the control unit 12 performs the operations until the fuel decrease quantity AFLL is sampled at the time the lean combustion limit is reached as the result of the forced enleanment. In the step S33, the determination of the fuel characteristic based on the sampled data is not performed yet.

At a step S34, the control unit 12 determines whether the detection of AFLL has been completed, and waits until the completion of the AFLL detecting operation. Then, the control unit 12 proceeds to a step S35.

In this embodiment, it is possible to reverse the order of the detection of the rich combustion limit in the step S31 and the detection of the lean combustion limit in the step S33. In any case, the control unit 12 performs either of the rich limit detection and the lean limit detection first, and performs the other subsequently.

At the step S35, the control unit 12 calculates a ratio X of the data item AFRL representing the rich combustion limit to the data item AFLL representing the lean combustion limit (X=AFRL/AFLL).

At a next step S36, the control unit 12 determines the volatility of the fuel in dependence on the thus-determined ratio X.

The data items AFRL and AFLL are influenced by various factors of statistical dispersion and scattering, such as a detection error of the air flow sensor 13, and an injecting characteristic of the fuel injector 6 of the selected cylinder. Since these factors acts about equally on the data items AFRL and AFLL, the calculation of the ratio X can cancel out the influences of errors. When a rate of error (or a relative error) is k, then AFR←AFR(correct value)×k, and AFL←AFL(correct value)×k, and accordingly the influence of k is eliminated in the ratio X calculated from the actually sensed values AFRL and AFLL.

Therefore, the detection system according to the third embodiment can detect the fuel characteristic more accurately without being affected by cylinder to cylinder variations in the air/fuel ratio, and errors in the air/fuel ratio control common to all the cylinders.

Instead of the ratio X=AFRL/AFLL, it is optional to employ a ratio X'=AFLL/AFRL and change the table characteristic for conversion from the ratio to the fuel volatility.

The detections of AFRL and AFLL in the same cylinder can be done consecutively immediately after a start of the engine as in the example of FIG. 5. In the third embodiment, however, it is optional to first detect one of AFRL and AFLL in a first engine starting operation, and then detect the other of AFRL and AFLL in the same cylinder in the next engine restarting operation if the fuel is not replenished during the stopping of the engine. In this case, the detection system first determines the fuel characteristic only by the rich combustion limit (AFRL), for example, in the first start of the engine. When the engine is restarted next without fuel replenishment, then the detection system detects the lean combustion limit (AFLL) in the same specified cylinder, and modifies the first determined fuel characteristic in accordance with both the result (AFRL) of the previous detection and the result (AFLL) of the current detection, to a more accurate value.

Figure 6:
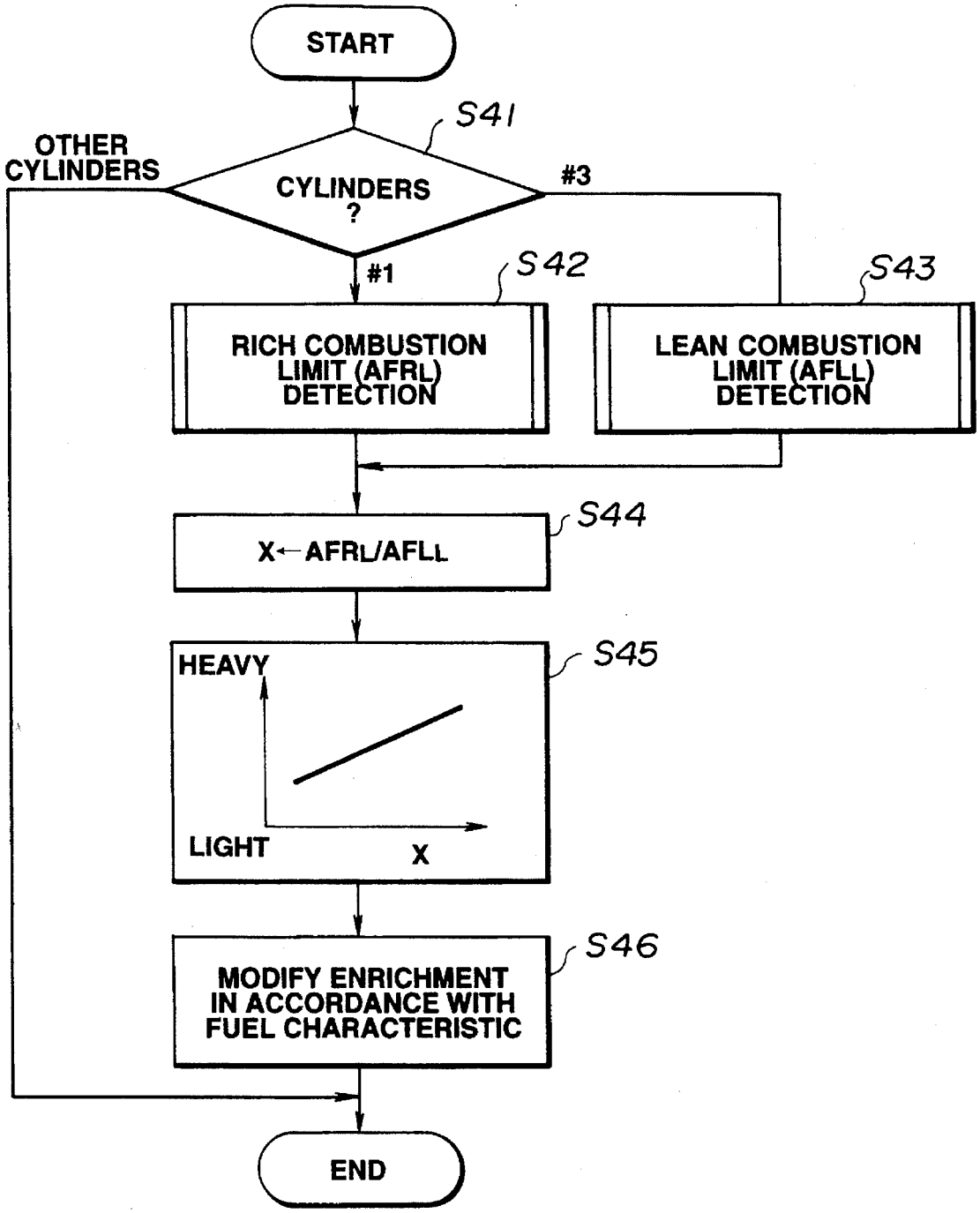
FIG. 6 is a flow chart showing a fuel characteristic detecting procedure according to a fourth embodiment of the present invention.

FIG. 6 shows a fuel characteristic detection procedure according to a fourth embodiment of the present invention. In the third embodiment of FIG. 5, the rich combustion limit representing data item AFRL and the lean combustion limit representing data item AFLL are detected in the same cylinder. In the fourth embodiment, the detections of AFRL and AFLL are done by using two different selected cylinders. For example, #1 cylinder and #3 cylinder may be selected in a four-cylinder engine.

In the example of FIG. 6, the detection system detects the rich combustion limit (AFRL) by a forcible enrichment in a first selected cylinder (#1 cylinder, for example) by proceeding from a step S41 for discriminating the cylinders, to a step S42. By using a selected cylinder (#3 cylinder, for example) on the other hand, the detection system detects the lean combustion limit (AFLL)by a forcible enleanment at a step S43. Then, the detection system determines the ratio X of the rich limit data AFRL in the first selected cylinder to the lean limit data AFLL in the second selected cylinder at a step S44, and determines the fuel characteristic in accordance with the ratio X at a step S45.

This detection system can cancel the common air/fuel ratio errors common to all the cylinders, such as a detection error of the air flow sensor. Furthermore, the forcible enrichment and enleanment can be performed simultaneously. Therefore, the parallel detection system according to the fourth embodiment is superior in the time required for detection, to the sequential operation system of FIG. 5.

The data of the detected fuel characteristic may be eliminated when the ignition switch of the engine is turned off. However, it is optional to save the fuel characteristic data for further use in the next restart of the engine. For example, the detection system according to the present invention may further comprise a means for determining whether a fresh supply of fuel is added to the tank or not during the stoppage of the engine, by monitoring the amount of fuel in the tank, for example. When the tank is not refueled, the detection system can consider the fuel property remains the same, and use the fuel characteristic data detected in the previous engine operation invariably without updating. Moreover, the detection system may be arranged to detect the fuel characteristic again even when fuel is not newly supplied, and to determine the fuel characteristic by comparing the previous result of detection in the previous start and the newly obtained result of the current engine restart.

As explained above, the detection system or the detection and control system according to the present invention detects the rich or lean side combustion limit air/fuel ratio by forcing a change of the air fuel mixture until the combustion pressure reaches a predetermined (unstable) condition, and determines the characteristic property of the fuel by the result of the detection. Therefore, the system can reliably catch a change in the stability of combustion due to a change of the air/fuel mixture without affecting the engine performance, and detects the characteristic property of the fuel accurately and quickly. By detecting both the rich and lean combustion limit air/fuel ratios, the system according to the present invention can improve the accuracy of the detection.

An engine system according to the present invention is suitable as a prime mover for a vehicle. When any one of the illustrated embodiments is applied to a vehicle, the vehicle comprises an engine control system which comprises: an internal combustion engine (such as the item 1 in FIG. 1) comprising a set of engine cylinders which is divided into a first nonnull subset comprising a first unselected cylinder which is one of said engine cylinders, and a second nonnull subset comprising a first selected cylinder which is another of said engine cylinders. Thus, each cylinder belongs either to the first cylinder subset or the second cylinder subset, but does not belong to both. The number of cylinders belonging to the second subset is equal to one in the examples of FIGS. 3–5, and equal to two in the example of FIG. 6. In these examples, the number of cylinder or cylinders of the second subset is equal to or smaller than the number of cylinder or cylinders of the first subset.

The engine control system of the vehicle may comprise a pressure sensing means (such as the item 16) for sensing a combustion pressure in said first selected cylinder; and an engine condition sensing means (such as the items 13, 14 or 15) for sensing at least one engine operating condition, such as an engine operating condition indicative of an engine speed and/or an engine operating condition indicative of an engine load, and/or an engine operating condition indicative of an engine temperature.

The engine control system of the vehicle may further comprise a fuel supplying means (6) for varying a fuel supply quantity to said unselected cylinder and a fuel supply quantity to said selected cylinder in response to respective fuel control signals. Therefore, the fuel supplying means is capable of differentiating the fuel supply to the selected cylinder from that to the unselected cylinder.

The engine control system of the vehicle may further comprise a control unit (12) for producing said respective fuel control signals for controlling the fuel supply quantities to said unselected and selected cylinders in a normal mode in accordance with the engine operating condition sensed by the engine condition sensing means. The control unit may comprise an onboard microcomputer.

This control unit may comprise a modifying means for determining a first (monitored) parameter (such as ΔPi) from the combustion pressure of said selected cylinder; for forcibly varying the fuel supply quantity for the selected cylinder to one of a rich side and a lean side until the first (monitored) parameter becomes equal to or greater than a predetermined level, by modifying the fuel control signal to said selected cylinder by a modification quantity (or an amount of modification) (such as AFR or AFL) which is increased at a predetermined rate (for example, such a rate that a predetermined amount α is added at predetermined regular time intervals) in one of an enriching direction and an enleaning direction until the first (monitored) parameter becomes equal to or greater than said predetermined level; for determining a second (judgment) parameter (such as AFRL or AFLL) by a value which the modification quantity reaches when the said first (monitored) parameter becomes equal to or greater than said predetermined level; and determining a third (fuel characteristic) parameter in accordance with the second (judgment) parameter. The first (monitored) parameter is an observable quantity indicative of the degree of instability of the combustion in the selected cylinder. The predetermined level of the first (monitored) parameter is indicative of a condition at one of a rich combustion limit and a lean combustion limit. The second (judgment) parameter is a variable indicative of the value of the air/fuel ratio in the selected cylinder at the instant the first (monitored) parameter has reached the predetermined level, or indicative of an air/fuel ratio at one of the rich combustion limit and the lean combustion limit. The third (fuel characteristic) parameter is indicative of a characteristic of fuel such as the volatility of fuel, and may be in form of a monotone increasing or decreasing function of the second (judgment) parameter. In the characteristic shown, as an example, in the step S8 of FIG. 3, the third (fuel characteristic) parameter increases linearly as the second (judgment) parameter increase. In the case of the step S28, the third (fuel characteristic) parameter decreases linearly with increase in the second (judgment) parameter.

In the examples of FIGS. 5 and 6 according to the third and fourth embodiments, said modifying means of the control unit may comprise:

an enriching means for forcibly and temporarily increasing the fuel supply quantity for the first selected cylinder to the rich side until the monitored parameter becomes equal to or greater than a predetermined rich side level, by modifying the fuel control signal to said selected cylinder by an amount of increase (or an increase quantity) (such as AFR) which is increased at a predetermined rate in the enriching direction until the monitored parameter becomes equal to or greater than said predetermined rich side level, and for determining a rich side judgment parameter (such as AFRL) by a value which the amount of increase (AFR) reaches when the said monitored parameter becomes equal to or greater than said predetermined rich side level;

an enleaning means for forcibly and temporarily decreasing the fuel supply quantity for a second selected cylinder belonging to said second subset to the lean side until the monitored parameter becomes equal to or greater than a predetermined lean side level, by modifying the fuel control signal to said second selected cylinder by an amount of decrease (or a decrease quantity) (such as AFL) which is increased at a predetermined rate in the enleaning direction until the monitored parameter becomes equal to or greater than said predetermined lean side level, for determining a second (lean side) judgment parameter (such as AFLL) by a value which the amount of decrease (AFL) reaches when the said monitored parameter becomes equal to or greater than said predetermined lean side level; and a fuel characteristic determining means for determining a fourth (composite) parameter (such as X or 1/X) in accordance with said first and second judgment parameters (AFRL and AFLL), and then determining the third (fuel characteristic) parameter in accordance with the composite parameter. The fuel characteristic parameter may be in the form of a monotone increasing or decreasing function of the composite parameter. The first and second selected cylinders may be one and the same cylinder, or alternatively they may be two different cylinders.

The control unit may further comprises an adjusting means for adjusting an engine control characteristic, such as a fuel supply control (or a fuel enrichment control), or an ignition timing control, for all the cylinders in accordance with the fuel characteristic parameter, and controlling the engine according to the thus-adjusted control characteristic at least until the engine is stopped. The control system may further comprise an ignition switch for starting and stopping the engine, and the modifying means may be arranged to perform a sequence of operations to determine the fuel characteristic only once immediately after the engine is turned on by the ignition switch.

What is claimed is:

1. A fuel characteristic detecting system for an internal combustion engine, comprising:

a combustion pressure variation sensing means for sensing a variation of a combustion pressure in a specified cylinder of the engine;

an air/fuel ratio controlling means for forcibly varying an air/fuel ratio for the specified cylinder until the variation of the combustion pressure sensed by said combustion pressure variation sensing means becomes equal to or greater than a predetermined level; and a fuel characteristic detecting means for determining a fuel characteristic in accordance with an air/fuel ratio in said specified cylinder obtained when the variation of the combustion a pressure is made equal to or greater than the predetermined level by the forcible variation of the air/fuel ratio by the air fuel ratio controlling means.

2. A fuel characteristic detecting system according to claim 1 wherein said system comprises a fuel supplying means for each of cylinders of the engine, and said air/fuel ratio controlling means includes a means for forcibly varying only a fuel supply quantity by said fuel supplying means to said specified cylinder by a forcible variation to forcibly vary the air/fuel ratio of said specified cylinder, said forcible variation of the fuel supply quantity to said specified cylinder being one of a forcible increase of the fuel supply quantity to said specified cylinder and a forcible decrease of the fuel supply quantity to said specified cylinder.

3. A fuel characteristic detecting system according to claim 2 wherein said fuel characteristic detecting means includes a means for determining the air/fuel ratio at the time that the variation of the combustion pressure becomes equal to or greater than the predetermined level, in accordance with the forcible variation of the fuel supply quantity to said specified cylinder.

4. A fuel characteristic detecting system according to claim 2 wherein said air/fuel ratio controlling means includes a means for performing both of an increasing control for increasing the air/fuel ratio in a first specified cylinder, and a decreasing control for decreasing the air/fuel ratio in a second specified cylinder, and said fuel characteristic detecting means includes a means for determining the fuel characteristic finally in accordance with a result of detection by said increasing control and a result of detection by said decreasing control.

5. A fuel characteristic detecting system according to claim 4 wherein said first and second specified cylinders are one and the same cylinder.

6. A fuel characteristic detecting system according to claim 4 wherein said second specified cylinder is a cylinder other than said first specified cylinder.

7. An engine control system comprising:

an internal combustion engine comprising first and second cylinders;

a pressure sensing means for sensing a combustion pressure in said second cylinder;

an engine condition sensing means for sensing an engine operating condition;

a fuel supplying means for varying fuel supply quantities to said first and second cylinders, respectively, in response to first and second fuel control signals; and a control unit for producing said first and second fuel control signals for controlling the fuel supply quantities to said first and second cylinders in accordance with the engine operating condition sensed by said engine condition sensing means;

wherein said control unit comprises a modifying means for determining a monitored parameter indicative of a variation of the combustion pressure, from the combustion pressure of said second cylinder; for forcibly varying the fuel supply quantity for the second cylinder to one of a rich side and a lean side until the monitored parameter becomes equal to or greater than a predetermined level, by modifying only the fuel control signal to said second cylinder by a modification quantity which is increased at a predetermined rate in one of an enriching direction and an enleaning direction until said monitored parameter becomes equal to or greater than said predetermined level; for determining a judgment parameter by a value which said modification quantity amounts to when the said monitored parameter becomes equal to or greater than said predetermined level; and for determining a fuel characteristic parameter indicative of a characteristic of fuel for the engine in accordance with the judgment parameter.

8. An engine control system according to claim 7 wherein said modifying means of the control unit comprises:

an enriching means for increasing the fuel supply quantity for said second cylinder to the rich side until the monitored parameter becomes equal to or greater than a predetermined rich side level, by modifying the fuel control signal to said second cylinder by an increase quantity which is increased at a predetermined rate in the enriching direction until the monitored parameter becomes equal to or greater than said predetermined rich side level, and for determining a rich side judgment parameter by a value which said increase quantity reaches when the said monitored parameter becomes equal to or greater than said predetermined rich side level;

an enleaning means for decreasing the fuel supply quantity for said second cylinder to the lean side until the monitored parameter becomes equal to or greater than a predetermined lean side level, by modifying the fuel control signal to said second cylinder by a decrease quantity which is increased at a predetermined rate in the enleaning direction until the monitored parameter becomes equal to or greater than said predetermined lean side level, for determining a lean side judgment parameter by a value which said decrease quantity reaches when the said monitored parameter becomes equal to or greater than said predetermined lean side level; and a fuel characteristic determining means for determining a composite parameter in accordance with said first and second judgment parameters, and then determining the fuel characteristic parameter in accordance with the composite parameter.

9. An engine control system according to claim 8 wherein one of said enriching means and said enleaning means includes a means for producing a completion signal indicating completion of determination of one of said rich side judgment parameter and said lean side judgment parameter, and the other of said enriching means and said enleaning means includes a means for allowing initiation of determination of the other of said rich side judgment parameter and said lean side judgment parameter upon receipt of said completion signal.

10. An engine control system according to claim 7 wherein said engine further comprises a third cylinder in addition to said first and second cylinders, and said pressure sensing means comprises pressure sensors for sensing the combustion pressure in said second cylinder and a combustion pressure in said third cylinder, respectively; and wherein said modifying means of the control unit comprises:

an enriching means for determining a first monitored parameter indicative of a variation of the combustion pressure in said second cylinder, from the combustion pressure of said second cylinder, increasing the fuel supply quantity for said second cylinder to the rich side until the first monitored parameter becomes equal to or greater than a predetermined rich side level, by modifying the fuel control signal to said second cylinder by an increase quantity which is increased at a predetermined rate in the enriching direction until the first monitored parameter becomes equal to or greater than said predetermined rich side level, and for determining a rich side judgment parameter by a value which said increase quantity reaches when the said monitored parameter becomes equal to or greater than said predetermined rich side level;

an enleaning means for determining a second monitored parameter indicative of a variation of the combustion pressure in said third cylinder, from the combustion pressure of said third cylinder, decreasing the fuel supply quantity for said third cylinder to the lean side until the second monitored parameter becomes equal to or greater than a predetermined lean side level, by modifying the fuel control signal to said third cylinder by a decrease quantity which is increased at a predetermined rate in the enleaning direction until the second monitored parameter becomes equal to or greater than said predetermined lean side level, for determining a lean side judgment parameter by a value which said decrease quantity reaches when the said second monitored parameter becomes equal to or greater than said predetermined lean side level; and a fuel characteristic determining means for determining a composite parameter in accordance with said first and second judgment parameters, and then determining the fuel characteristic parameter in accordance with the composite parameter.

11. An engine control system according to claim 10 wherein said control unit comprises a means for allowing said enriching means to perform an enriching operation to enrich an air/fuel mixture to said second cylinder and further allowing said enleaning means to enlean an air/fuel mixture to said third cylinder simultaneously with said enriching operation of said enriching means.

* * * * *